US006423482B1

(12) United States Patent
Lunt et al.

(10) Patent No.: US 6,423,482 B1
(45) Date of Patent: Jul. 23, 2002

(54) PHOTOGRAPHIC ELEMENT AND PACKAGE

(75) Inventors: Sharon R. Lunt, Webster; John F. Sawyer, Fairport; Mitchell M. Lin, Penfield, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/731,425

(22) Filed: Dec. 6, 2000

(51) Int. Cl.[7] ..... G03C 1/46

(52) U.S. Cl. ..... 430/505; 430/506; 430/508; 430/509; 430/379

(58) Field of Search ..... 430/505, 506, 430/508, 379, 509

(56) References Cited

U.S. PATENT DOCUMENTS 5,314,794 A * 5/1994 Sutton ..... 430/506
5,389,506 A * 2/1995 Sutton ..... 430/506
5,817,452 A * 10/1998 Kamosaki ..... 430/506

FOREIGN PATENT DOCUMENTS

JP SHO 631988-85545 4/1988

* cited by examiner

*Primary Examiner*—Geraldine Letscher
(74) *Attorney, Agent, or Firm*—Arthur E. Kluegel

(57) ABSTRACT

Disclosed is a color photographic element comprising a multilayered blue light sensitive record, a multilayered green light sensitive record, and a multilayered red light sensitive record, the red record comprising two or more layers of differing light sensitivity, the most light sensitive layer of the red record containing a red light sensitized first emulsion having at least one wavelength of peak absorption, and at least one of the two most light sensitive layers of the red record containing a red sensitized second emulsion, wherein the first emulsion exhibits, as measured at 0.2 density units above Dmin, at least one wavelength of peak absorption that is longer than the shortest wavelength of peak absorption of the second emulsion. The element provides an advantageous combination of speed and color rendition.

20 Claims, 3 Drawing Sheets

PHOTOGRAPHIC ELEMENT AND PACKAGE

FIELD OF THE INVENTION

This invention relates to a multilayer silver halide photographic element in which the red light sensitive record contains a relatively longer wavelength sensitized emulsion in the fastest layer and a relatively shorter wavelength sensitized emulsion in the fastest or second fastest layer.

BACKGROUND OF THE INVENTION

A typical silver halide multilayer color photographic element comprises a record sensitive to blue light, a record sensitive to green light, and a record sensitive to red light. Most often, the records are arranged so that the element is green over red, meaning that green light-sensitive record is above the red light-sensitive layer so that incident light is "seen" by the green record before the red record. Color negative elements typically have the blue sensitive layer on top, followed by the green and then the red. In order to obtain an accurate reproduction of an image, it is desirable that all three of these records accurately reproduce the colors and densities of the original subject. The red layer is normally sensitized with a dye or dyes that render the layers more sensitive at long wavelengths than the human visual system, and this can result in a failure to reproduce colors accurately.

It is desirable to have the red layer spectral sensitivity as close as possible to that of the human visual system from a pure color reproduction standpoint. If one were to attempt to identically reproduce the human eye spectral sensitivity with more short red sensitivity, another problem results. As the red spectral sensitivity is shifted to shorter and shorter wavelengths, there is a loss in red layer speed because the overlying green light sensitive layer undesirably filters out an increasing proportion of the incident light. The absorption curves of the green and red sensitive layers overlap and when the red layer is moved to ever shorter spectral sensitivities, this overlap is magnified and the filtering effect is increased. This in turn degrades the speed of the record.

Japanese published application J63/085545 discloses the possibility of sensitizing the fastest red light sensitive layer to be 3–30 nm shorter than the least sensitive red light sensitive layer in order to accurately reproduce certain shades of red. However, as indicated above, this improvement would be at the expense of speed since the shorter red sensitive fastest layer would be shadowed by the overlying green layer.

It is a problem to be solved to provide a multilayer color photographic element bearing a red light sensitive record that provides an advantageous combination of red speed and color accuracy.

SUMMARY OF THE INVENTION

The invention provides a color photographic element comprising a multilayered blue light sensitive record, a multilayered green light sensitive record, and a multilayered red light sensitive record, the red record comprising two or more layers of differing light sensitivity, the most light sensitive layer of the red record containing a red light sensitized first emulsion having at least one wavelength of peak absorption, and at least one of the two most light sensitive layers of the red record containing a red sensitized second emulsion, wherein the first emulsion exhibits, as measured at 0.2 density units above Dmin, at least one wavelength of peak absorption that is longer than the shortest wavelength of peak absorption of the second emulsion.

The invention also provides a package containing the element with prescribed development instructions or an indication of an exposure index or ISO speed of 400 or higher.

Elements of the invention are useful for providing an improved combination of speed and color rendition.

DETAILED DESCRIPTION OF THE INVENTION

The invention is as generally described above. The effect of the invention is obtained when emulsions of certain types are provided as indicated in the fastest two layers of the red record of a multilayer color element. The two emulsions differ in that the first emulsion is sensitized to have a wavelength of peak sensitivity, measured at a density 0.2 above Dmin, at a longer wavelength than the shortest peak sensitivity of the second emulsion. Typically the longer peak is more than 625 nm and usually more than 635 nm. The second emulsion has a shorter peak, typically less than 625 nm. The second emulsion desirably exhibits a slower speed (measured as a single layer) than the first.

Where the absorption of a single emulsion is referred to, it means the value determined form a monolayer sample of that emulsion. Where the absorption of a multilayer is referred to, it means the value determined form the multilayer as a whole.

It is common for an emulsion to be sensitized with a combination of dyes and this may result in multiple peak absorptions or maxima. Where there is only one peak, the invention provides that the peak of the first emulsion occurs at a longer wavelength than does the peak of the second emulsion. Where there is more than one peak, the invention provides that there is a t least one peak of the first emulsion that is longer than the shortest peak of the second emulsion.

Loss in color accuracy with this approach would be most noticed in under-exposed negatives where there is the greatest relative contribution of the fastest layer. Accordingly, the color accuracy was evaluated at an exposure that is 1 stop, or 0.3 log E, less than normal. This degree of under-exposure will still produce a good image, and hence be critical for color accuracy. The criterion for color accuracy is based on the CIE 1994 recommendations for measuring color accuracy (Commision International de L'Eclairage (CIE), "Industrial Colour-Defference Evaluation," Technical Report 116-1995. For hue shifts in a photographic system, the parameter is $\Delta H^*/S_H$ where $S_H=1+0.015\times(C_1C_2)$ and $C_1$ and $C_2$ are the chroma of the reference and test color patch. $\Delta H^*$ is calculated from the equation:

$$\Delta H^*=\sqrt{\Delta E^{*2}-\Delta L^{*2}-\Delta C^{*2}}$$

In CIELAB coordinates, $\Delta E^*=\sqrt{\Delta L^{*2}-\Delta a^{*2}-\Delta b^{*2}}$ and $\Delta C^*=C_1-C_2$ where $C^*=\sqrt{a^{*2}+b^{*2}}$.

Figure 1:
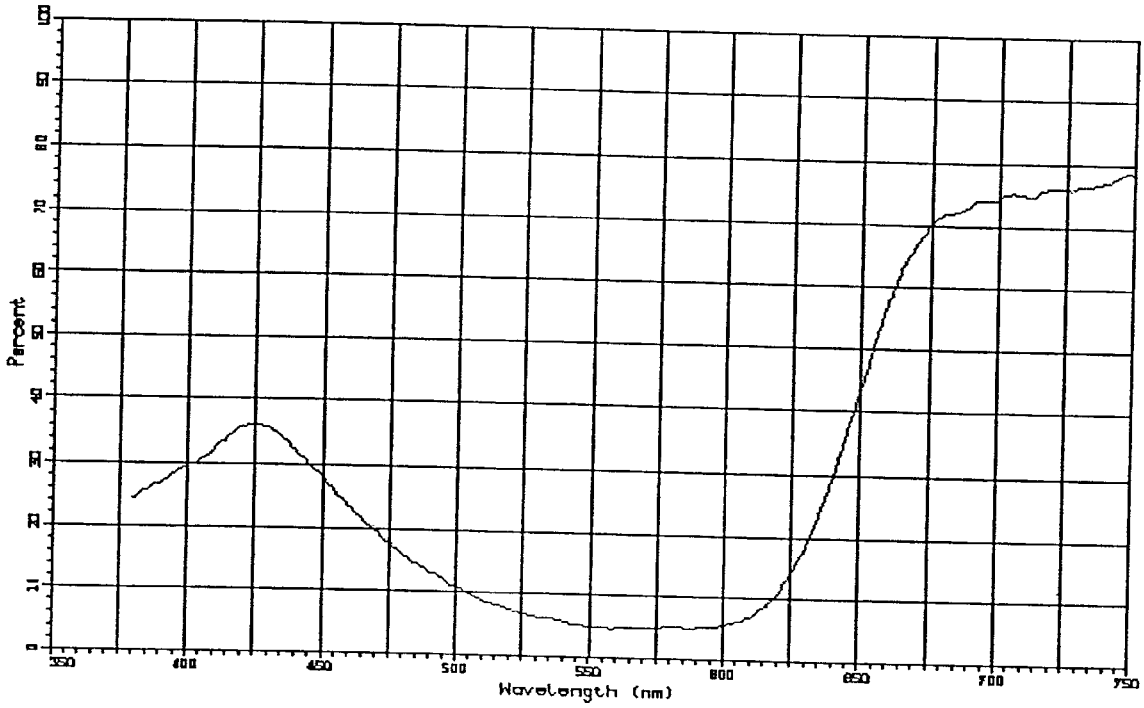
FIG. 1 is a graph that shows the % Transmission vs. Wavelength for a Purple Test Patch.

The hue angle shift for a color that is expected to be sensitive to changes in red spectral sensitivity was measured. The spectral reflectance of the selected purple test color is shown in FIG. 1. The reproduction of this purple test color was found to be particularly sensitive to changes in red spectral sensitivity.

The spectral sensitivity of a color photographic element can be measured at different exposures, or, equivalently, different densities above Dmin. We measure the spectral sensitivity at two densities, (1) 0.2 density above Dmin and (2) 0.7 density above Dmin. The former response is representative of the threshold sensitivity and the latter response is representative of a normal exposure.

The present invention is particularly suited for a photographic element that has a peak sensitivity for the entire red record in of less than 635 nm at 0.7 density above Dmin, and more desirably less than 625 nm. Such records are useful for more accurate reproduction of color but present speed problems for the reasons indicated. The peak of the first emulsion is typically at least 5 nm longer than the peak of the second emulsion and desirably much longer than that such as in the range of 10–50 nm or 30–50 nm longer.

In order to provide the desired improvement in speed without significantly degrading the color rendition, it is desirable that the first long red sensitized emulsion is faster than the second short red sensitized emulsion by at least 0.1 log E, desirably 0.2 log E, and even 0.4 or 0.6 log E. The speed of an individual emulsion is determined by preparing a single layer sample and subjecting the sample to a stepwise exposure and determining the log exposure value at 0.15 density above Dmin.

The long red emulsion is present in the fastest red sensitive layer. It may be present alone in this layer or may be present in combination with one or more short red emulsions. When used in the same layer, it is typical that the long red emulsion comprises from 5–80 wt. %, 10–70 wt. %, or 15–50 wt. % of the total of emulsions contained in that layer.

In one embodiment, the fastest layer is comprised entirely of the first long red sensitized emulsion.

The image is formed in the element by exposure to actinic radiation, as described hereinafter. Printing is accomplished by either using light to form a print optically or by using a scanner to read the film and then print a corresponding positive image using a marking engine containing a laser, LED, CRT, or other suitable radiation source.

The photographic elements of the invention are so-called color negative elements capable of producing multicolor images. Such elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art.

A typical multicolor photographic negative element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office. When it is desired to employ the inventive materials in a small format film, *Research Disclosure*, June 1994, Item 36230, provides suitable embodiments. The photographic element of the invention can be incorporated into exposure structures intended for repeated use or exposure structures intended for limited re-use, variously referred to by names such as "one time or single use cameras", "lens with film", or "photosensitive material package units".

The materials useful in the invention can be used in any of the ways and in any of the combinations known in the art. Typically, the materials are incorporated in a melt and coated as layers described herein on a support to form part of a photographic element.

To control the migration of various components, it may be desirable to include a high molecular weight hydrophobe or "ballast" group in some of the materials. Representative ballast groups include substituted or unsubstituted alkyl or aryl groups containing 8 to 48 carbon atoms.

In the following discussion of suitable materials for use in the emulsions and elements of this invention, reference will be made to *Research Disclosure*, September 1996, Item 38957, available as described above, which is referred to herein by the term "Research Disclosure". The Sections hereinafter referred to are Sections of the Research Disclosure.

Except as provided, the silver halide emulsion containing elements employed in this invention are negative-working and are processed in the conventional color negative manner as typically indicated by the processing instructions provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957.

Image dye-forming couplers are included in the element such as couplers that form cyan dyes upon reaction with oxidized color developing agents which are described in such representative patents and publications as: "Farbkuppler-eine Literature Ubersicht," published in Agfa Mitteilungen, Band III, pp.156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765;

5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyroloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the materials useful in the invention may be blocked or coated in protected form as described, for example, in Japanese Application 61/258,249 or U.S. Pat. No. 5,019,492.

The invention may further be used in combination with image-modifying compounds that release PUGS such as "Developer Inhibitor-Releasing" compounds (DIR's). DIR's useful in conjunction with the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969). Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

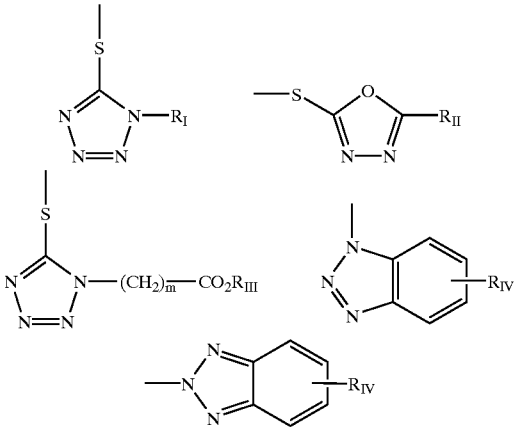

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

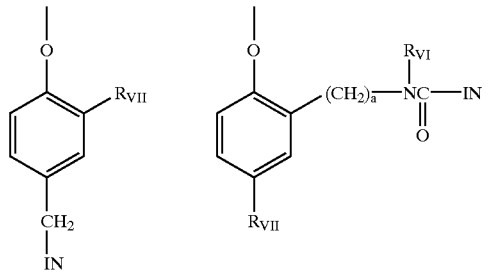

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1
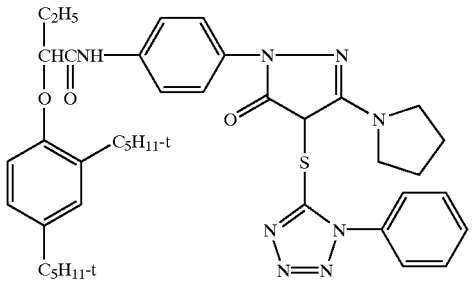
D2
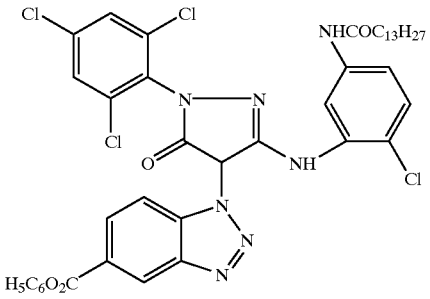
D3
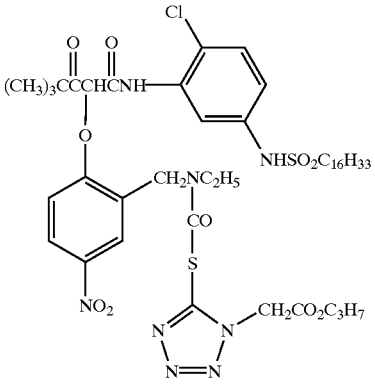
D4
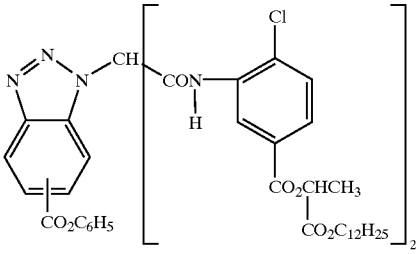
D5
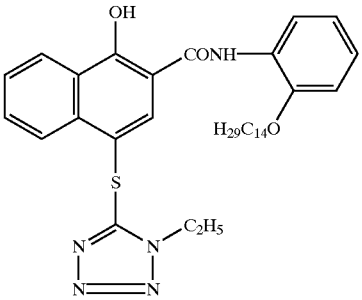
-continued
D6
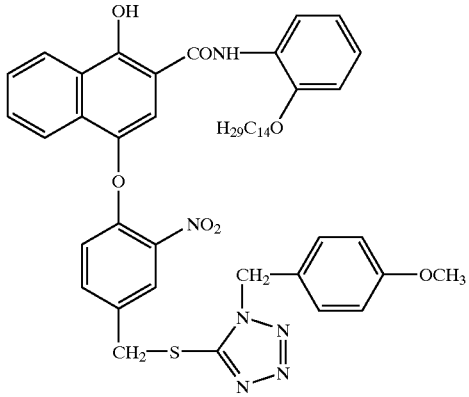
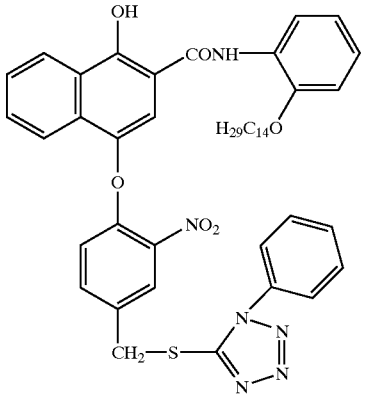
D8
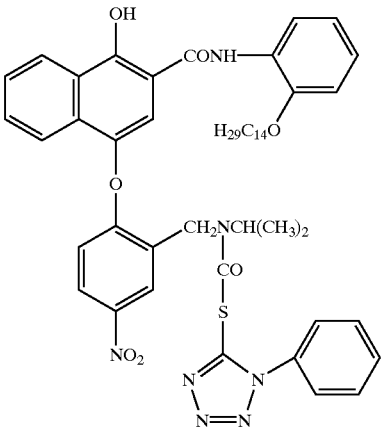
D9
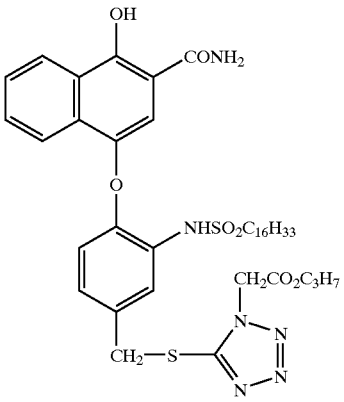

-continued

D10

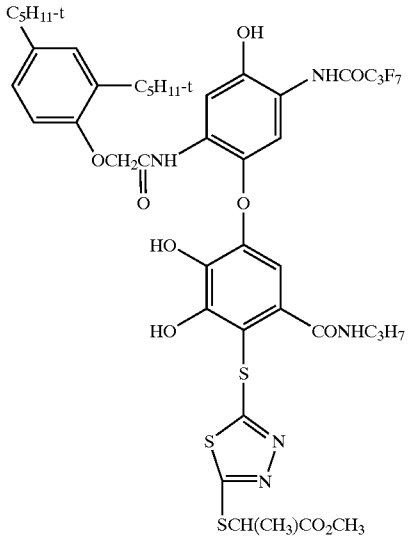

D11

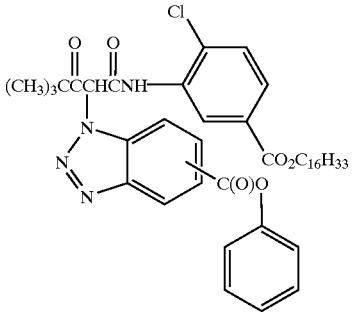

D12

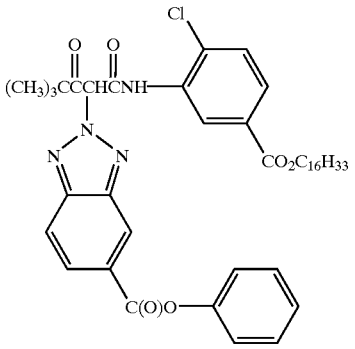

It is also contemplated that the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England. Materials useful in the invention may be coated on pH adjusted support as described in U.S. Pat. No. 4,917,994; on a support with reduced oxygen permeability (EP 553, 339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Conventional radiation-sensitive silver halide emulsions can be employed in the practice of this invention. Such emulsions are illustrated by *Research Disclosure*, Item 38755, September 1996, I. Emulsion grains and their preparation.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S.

Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color-developing agent. Oxidized color developing agent in turn reacts with the coupler to yield a dye. If desired "Redox Amplification" as described in Research Disclosure XVIIIB(5) may be used.

In the color negative image-capture type element of the invention, speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. Color negative development times are typically 3'15" or less and desirably 90 or even 60 seconds or less.

A direct-view photographic element is one which yields a color image that is designed for human viewing (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by digitally printing or by optically printing an image from a color negative element of the invention onto the direct-viewing element and processing through an appropriate negative-working photographic process to give a positive color image. The element may be sold packaged with instructions for digital printing or for processing using a color negative optical printing process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less. Color slides may be produced in a similar manner but are more typically produced by exposing the film directly in a camera and processing through a reversal color process using reversal processing such as Kodak E-6, or a direct positive process to give a positive color image. The foregoing images may also be produced by alternative processes such as digital printing.

Each of these types of photographic elements has its own particular requirements for dye hue, but in general they all require cyan dyes whose absorption bands are less deeply absorbing (that is, shifted away from the red end of the spectrum) than color negative films. This is because dyes in direct-view elements are selected to have the best appearance when viewed by human eyes, whereas the dyes in image capture materials are designed to best match the needs of the printing process.

Preferred color developing agents for the color negative elements of the invention are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying. However, scanning may also follow immediately after or during the development step.

The entire contents of the patents and other publications referred to in this specification and in the identified Research Disclosure publications are incorporated herein by reference.

The invention is demonstrated by the following examples.

Example 1

Sample A—Comparison

A comparison coating was made in which the cyan emulsions were all sensitized to have a short red peak less than 635 nm. The multilayer photographic film contained on a transparent acetate support the following:

| | mg/sq meter |
|---|---|
| Layer 1 | |
| Gray silver | 172 |
| Chem-2 | 16 |
| Dye-2 | 32 |
| Dye-3 | 2.7 |
| Dye-4 | 3.8 |
| Dye-5 | 75 |
| Chem-5 | 97 |
| Gelatin | 1990 |
| Layer 2 | |
| Slow cyan emulsion | 323 |
| Slow-slow cyan emulsion | 323 |
| Coup-1 | 446 |
| Coup-2 | 65 |
| Coup-3 | 15 |
| Coup-4 | 16 |
| Coup-6 | 16 |
| Coup-7 | 65 |
| Chem-1 | 10 |
| Gelatin | 1750 |
| Layer 3 | |
| Mid cyan emulsion | 635 |
| Coup-1 | 226 |
| Coup-3 | 56 |

-continued

| | mg/sq meter |
|---|---|
| Coup-4 | 19 |
| Coup-5 | 12 |
| Coup-6 | 12 |
| Coup-7 | 47 |
| Chem-1 | 10 |
| Gelatin | 940 |
| Layer 4 | |
| Fast cyan emulsion | 1076 Comp/538 Inv |
| Fast-fast cyan emulsion | 0 Comp/301 Inv |
| Coup-1 | 226 |
| Coup-3 | 43 |
| Coup-4 | 19 |
| Coup-5 | 19 |
| Coup-6 | 19 |
| Chem-1 | 15 |
| Gelatin | 1030 |
| Layer 5 | |
| Coup-4 | 16 |
| Chem-2 | 27 |
| Gelatin | 540 |
| Layer 6 | |
| Slow magenta emulsion | 258 |
| Slow-slow magenta emul. | 65 |
| Coup-8 | 283 |
| Coup-9 | 93 |
| Chem-1 | 4.8 |
| Gelatin | 1180 |
| Layer 7 | |
| Mid magenta emulsion | 635 |
| Coup-8 | 179 |
| Coup-9 | 72 |
| Coup-5 | 16 |
| Coup-10 | 4.3 |
| Chem-1 | 10 |
| Gelatin | 1240 |
| Layer 8 | |
| Fast magenta emulsion | 603 |
| Fast-fast magenta emul. | 312 |
| Coup-8 | 70 |
| Coup-9 | 76 |
| Coup-10 | 16 |
| Coup-5 | 13 |
| Chem-1 | 6.2 |
| Gelatin | 970 |
| Layer 9 | |
| Coup-11 | 16 |
| Chem-2 | 27 |
| Dye-1 | 22 |
| Chem-1 | 2.9 |
| Gelatin | 540 |
| Layer 10 | |
| Mid yellow emulsion | 258 |
| Slow yellow emulsion | 322 |
| Slow-slow yellow emul. | 172 |
| Coup-7 | 968 |
| Coup-2 | 5.4 |
| Coup-12 | 81 |
| Coup-4 | 32 |
| Coup-1 | 75 |
| Chem-1 | 8.8 |
| Chem-3 | 5.4 |
| Chem-4 | .0011 |
| Chem-7 | 26 |
| Gelatin | 1570 |
| Layer 11 | |
| Fast yellow emulsion | 377 |
| Fast-fast yellow emul. | 377 |
| Lippman emulsion | 54 |
| Coup-7 | 344 |

-continued

| | mg/sq meter |
|---|---|
| Coup-13 | 130 |
| Coup-12 | 113 |
| Coup-2 | 5.4 |
| Chem-1 | 10 |
| Chem-4 | .0011 |
| Gelatin | 1180 |
| Layer 12 | |
| UV dye 1 | 160 |
| UV dye 2 | 110 |
| Gelatin | 690 |
| Layer 13 | |
| Gelatin | 870 |

The above contains sequestrants, antifoggants, surfactants, antistat, matte beads and lubricants as is known in the art. The film also contains a hardener at 1.8% of total gel.

Coup-1

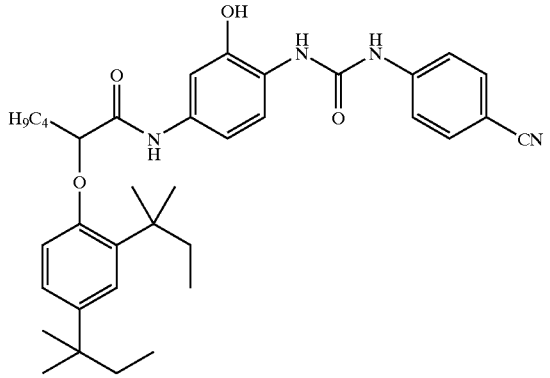

Coup-2

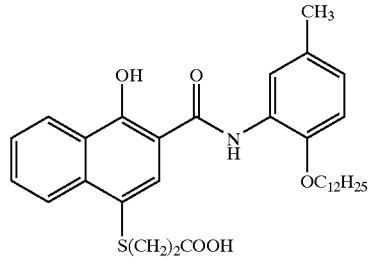

Coup-3

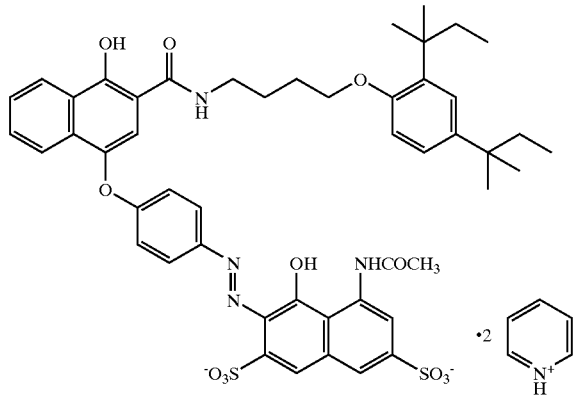

Coup-4
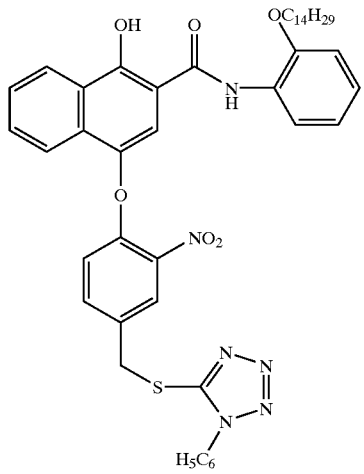
Coup-5
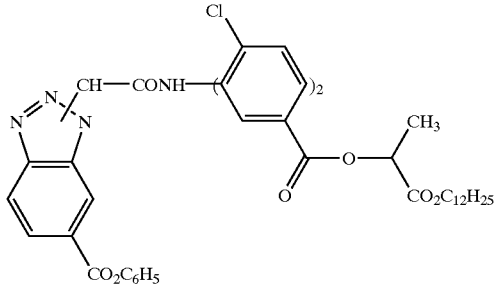
Coup-6
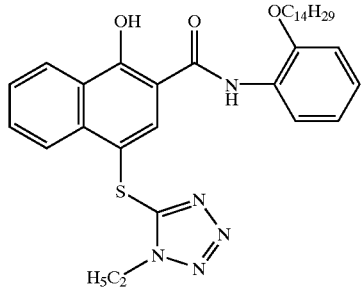
Coup-7
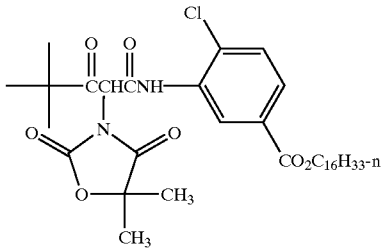
Coup-8
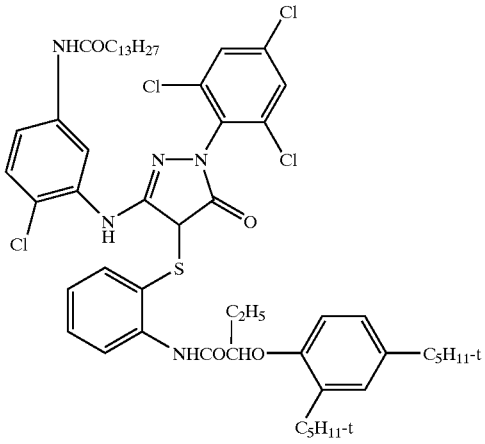
Coup-9
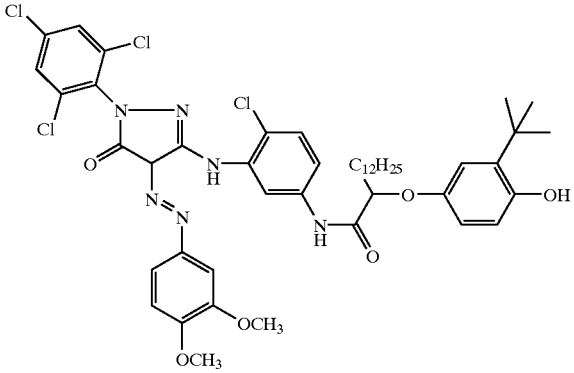
Coup-10
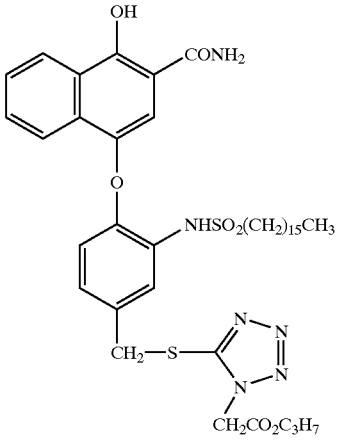

-continued

Coup-11

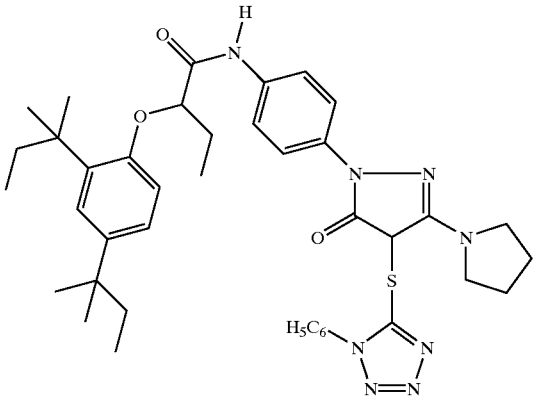

Coup-12

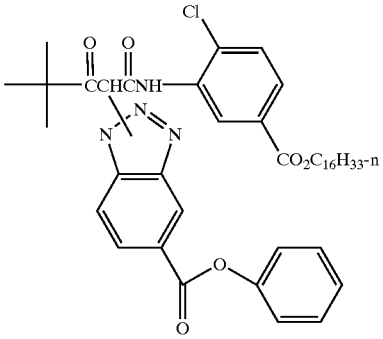

Coup-13

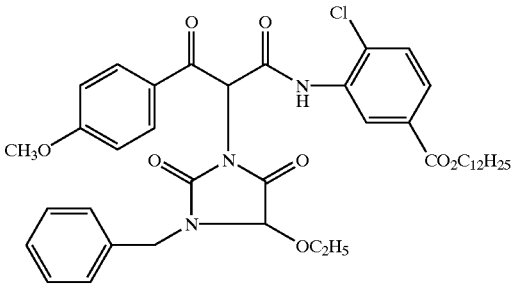

Chem-1 (1,2,4) Triazolo(1,5-a)pyrimidin-7-ol,5-methyl-, sodium salt

Chem-2

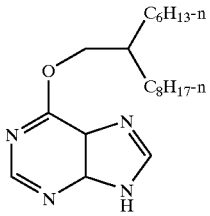

Chem-3 Cyclopenten-1-one,2,5-dihydroxy-5-methyl-3-(4-morpholinyl)-

Chem-4 N-(3-(2,5-dihydro-5-thioxo-1H-tetrazol-1-yl) phenyl) L-alanine disodium salt Chem-5

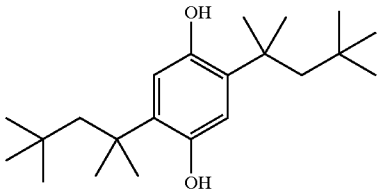

Dye-1

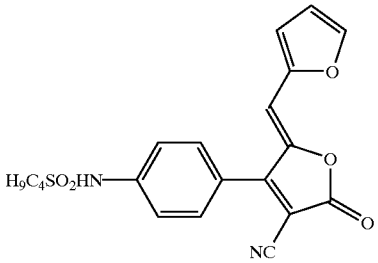

Dye-2

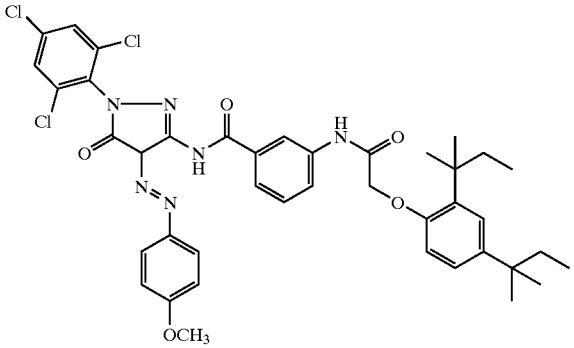

2,6-Anthracenedisulfonic acid, 9,10-dihydroxy-9,10-dioxo-4,8-

Dye-3 bis(sulfomethyl)amino)-,tetrasodium salt

Dye-4

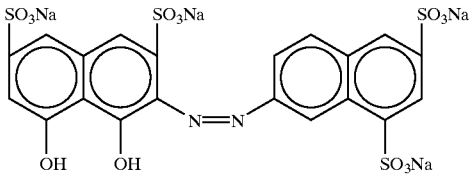

Dye-5 Propanedinitrile,(3-(dihexylamino)-2-propeneylidene)-

| Emulsion | Type | Diam-eter | Thick-ness | % bromide | Dye load | Dyes |
|---|---|---|---|---|---|---|
| SS cyan | T | .43μm | .11 μm | 99.5 | .66mm/m | C-1 |
| S cyan | T | .80 | .11 | 95.5 | .82 | C-1 |
| M cyan | T | 1.24 | .12 | 96.3 | 1.00 | C-1 |
| F cyan | T | 2.5 | .13 | 96.3 | .89 | C-1 |
| FF cyan | T | 3.9 | .13 | 96.3 | .79 | C-1 or C-3 |
| SS magenta | T | .53 | .083 | 98.7 | .89 | M-1 |
| S magenta | T | .47 | .12 | 97.0 | 1.04 | M-1 |
| M magenta | T | 1.01 | .13 | 95.5 | 1.03 | M-1 |

-continued
| Emulsion | Type | Diam-eter | Thick-ness | % bromide | Dye load | Dyes |
|---|---|---|---|---|---|---|
| F magenta | T | 1.86 | .13 | 95.5 | .95 | M-1 |
| FF magenta | T | 2.9 | .13 | 96.3 | .85 | M-1 |
| SS yellow | T | .53 | .083 | 98.7 | 1.1 | Y-1 |
| S yellow | T | .99 | .14 | 98.6 | .90 | Y-1 |
| M yellow | T | 1.26 | .14 | 95.8 | .80 | Y-1 |
| F yellow | T | 2.67 | .13 | 95.8 | .80 | Y-1 |
| FF yellow | 3D | 1.22 | | 90.3 | .22 | Y-2 |
Sensitizing dyes
C-1=SD1+SD2+SD3
C-2=SD1+SD2+SD4
C-3=SD1+SD10+SD4
M-1=SD5+SD6
Y-1=SD7+SD8
Y-2=SD9
SD1
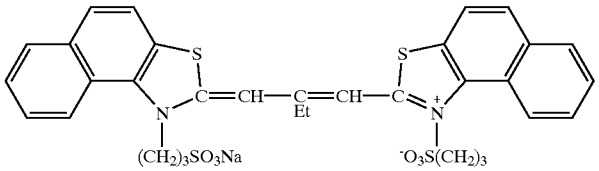
SD2
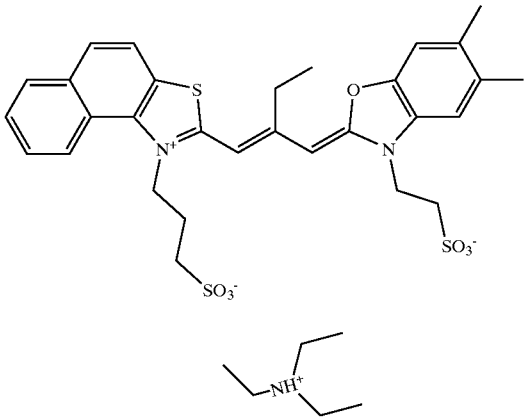
SD3
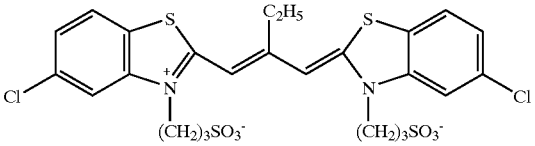
$HN^+ (C_2H_5)_3$ -continued
SD4
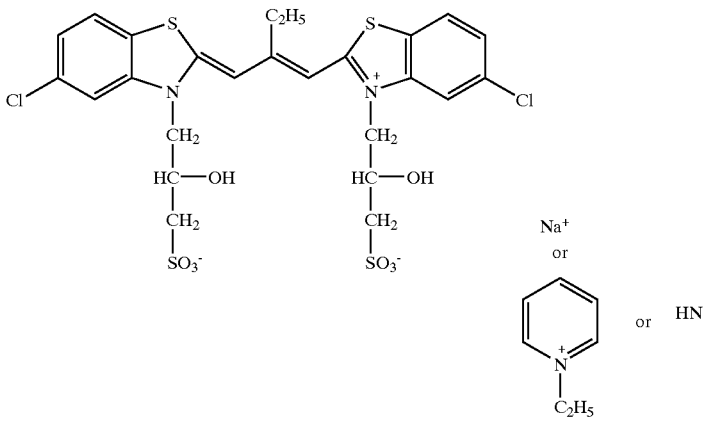
SD5
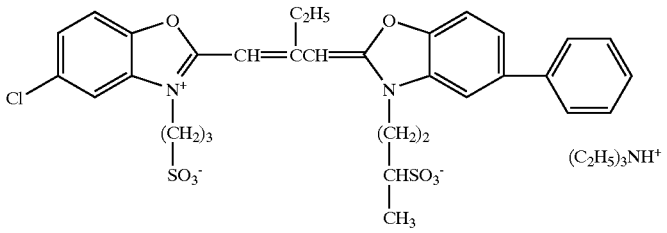
SD6
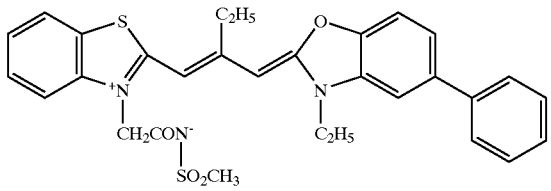
SD7
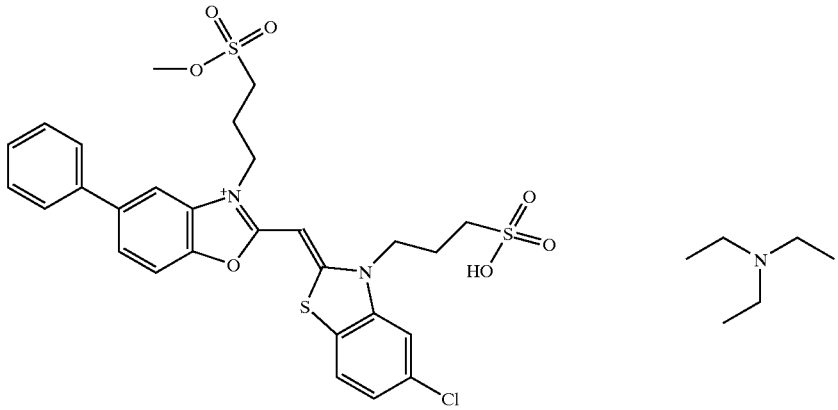
SD8
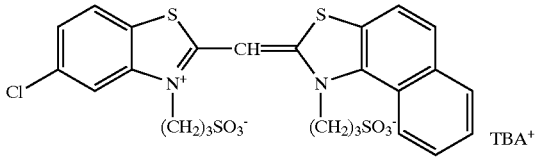

-continued

SD9

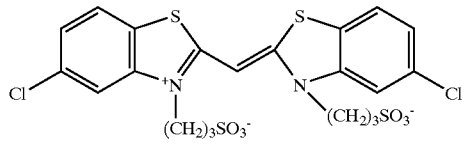

$HN^+ (C_2H_5)_3$

SD10

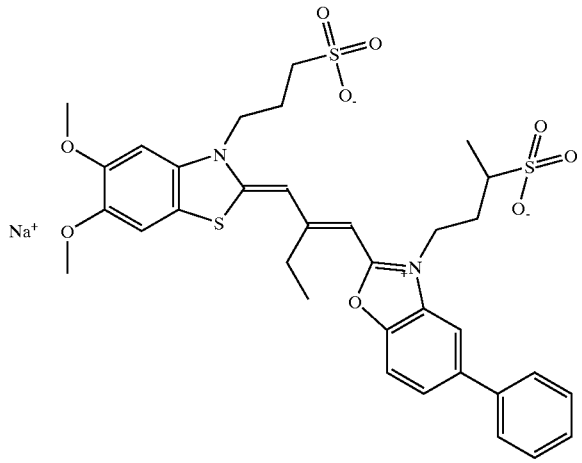

The reference coating had both the fast-fast emulsion and the fast emulsion containing only the short red spectral sensitivity.

Sample B—Invention

A coating was made as for Sample A and tested except there was employed as shown for layer 4 a blended fast cyan layer that contained 36 wt % of a fast-fast emulsion with a long red spectral sensitivity ((C3 at mole ratio of SD1: SD10: SD4 of 0.041:0.110:0.667 having a long red peak in sensitivity at approximately 650 nm) and 64% of a fast emulsion with a short red spectral sensitivity (SD1: SD2: SD3 of 0.034:0.670:0.168 having only a short peak sensitivity at approximately 620 nm).

The spectral sensitivities were measured at 0.2 and 0.7 density above Dmin. In addition, pictures were taken of the above purple test object.

Figure 2:
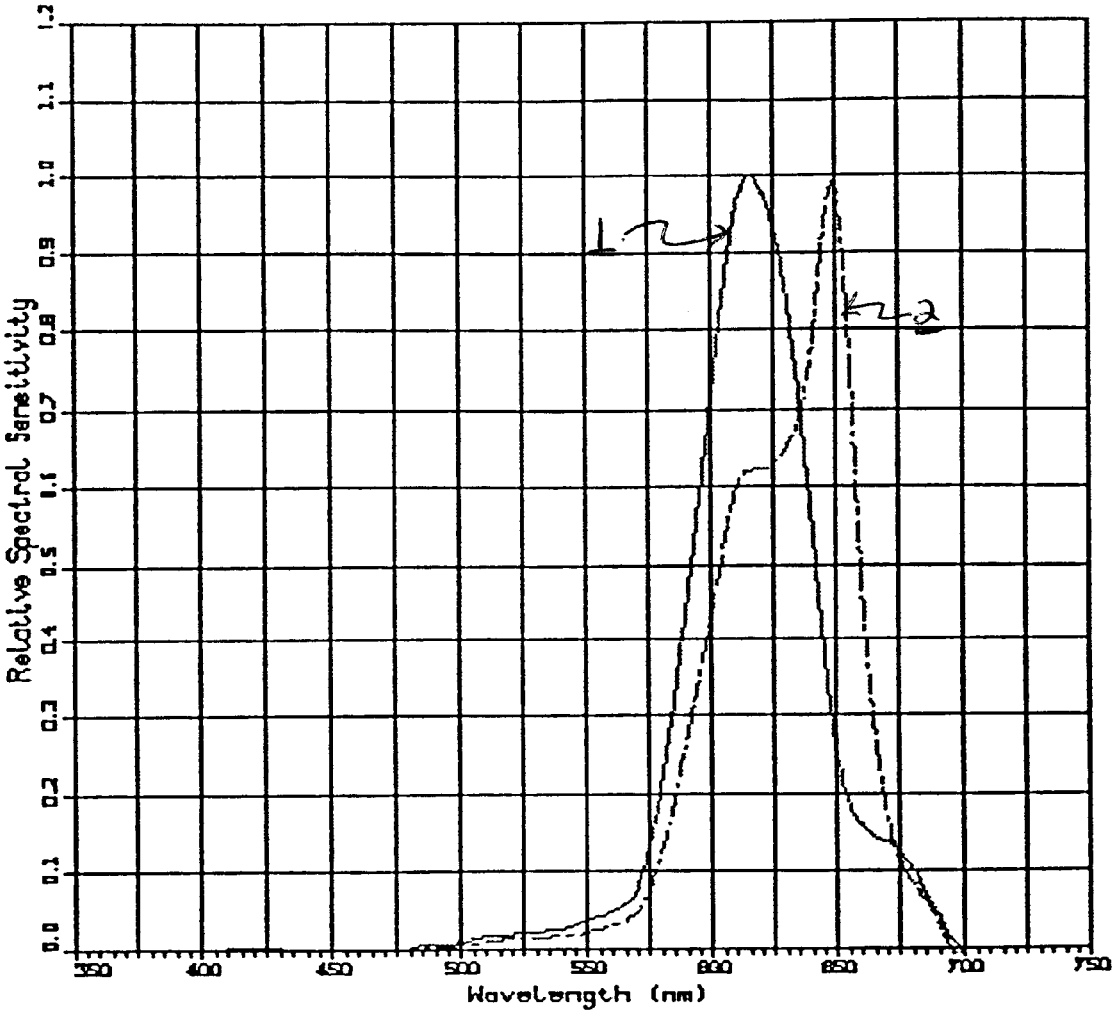
FIG. 2 is a graph that shows the Normalized Relative Spectral Sensitivity at 0.2 density above Dmin vs Wavelength for a photographic element of the invention and a comparison.
Figure 3:
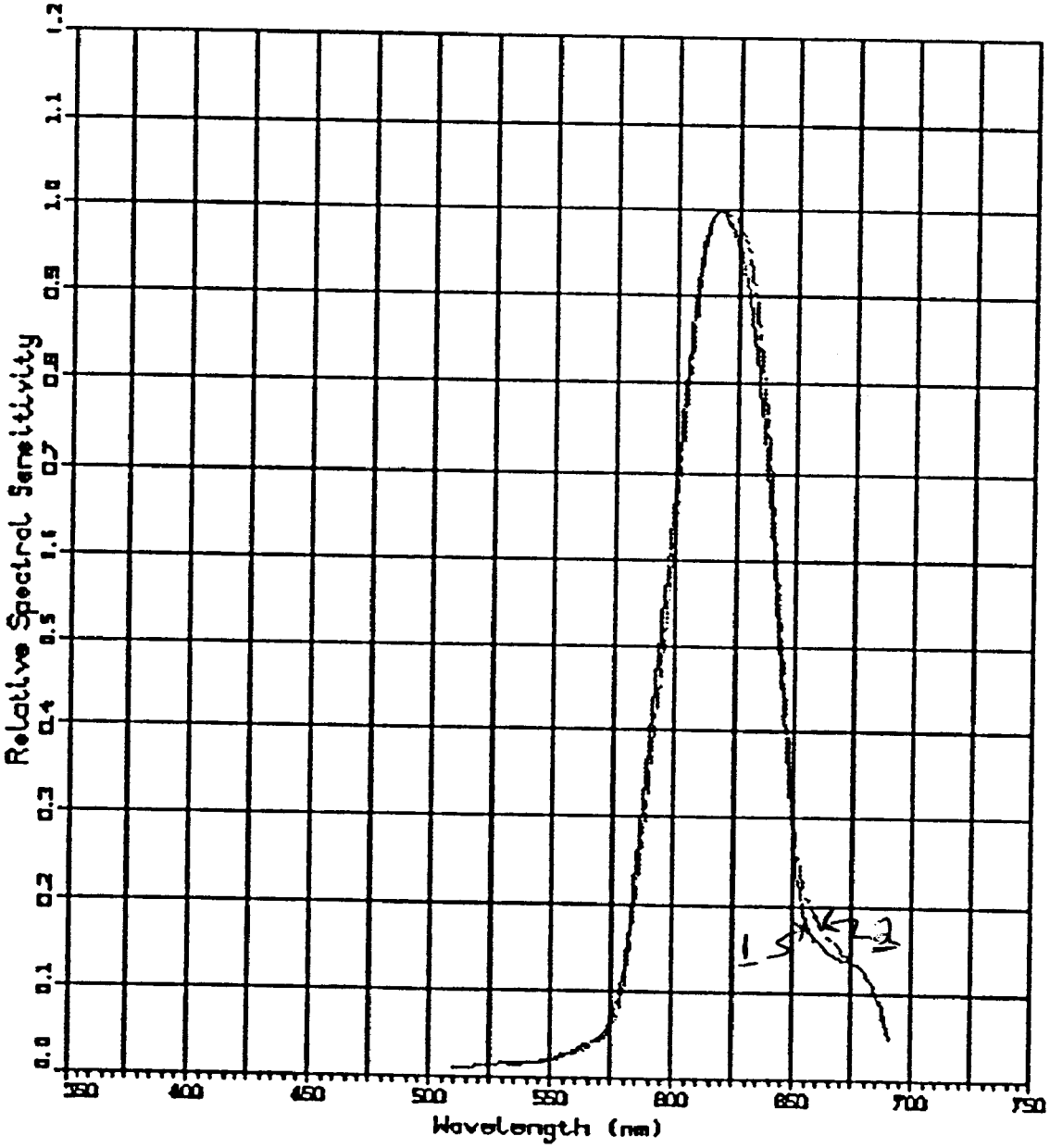
FIG. 3 is a graph that shows the Normalized Relative Spectral Sensitivity at 0.7 density above Dmin vs Wavelength for a photographic element of the invention and a comparison.

The spectral sensitivities, as measured at a density of 0.2 above Dmin, are shown in FIG. 2. The illustrated spectral sensitivities are linear and area normalized. It can be seen that there is a short red peak for SampleA (1) and a long red peak for Sample B (2). The large influence of the long red spectral sensitivity in the fast-fast emulsion can be seen at this density level. It could be expected that this coating would not give the more accurate color reproduction of a short red sensitization. However, FIG. 3 shows the sensitivities of these same two coatings when measured at 0.7 density above Dmin. It can be seen that there is little or no evidence of a different long red spectral sensitization (2) vs. the short red sensitization (1) of the fast-fast cyan emulsion.

Example 2

In addition, these coatings were used to photograph a gray card and the purple patch under D5500 illuminant. The camera exposures were adjusted to provide a "one-under" exposure. The negatives were optically printed onto Kodak Edge 8 color paper such that the gray card was a visual neutral. The print reproduction of the purple patch was measured spectrophotometrically and the hue parameters were calculated with respect to the original of the patch.

An acceptable hue shift is 2 units or less for this critical purple patch at the critical "one-under" exposure. It was observed that the hue shift parameter ($\Delta H^*/S_H$) for the invention was only 0.9 units, well within acceptable limits. Thus it is possible to have the advantage of an increase in threshold speed afforded by a long red sensitization yet still have the desired color reproduction of a short red sensitization. In addition, we have prepared and tested three other examples that are consistent with the above example. They differ in the sensitization of the long red and the ratio of the long red to the short red.

What is claimed is:

1. A color photographic element comprising a multilayered blue light sensitive record, a multilayered green light sensitive record, and a multilayered red light sensitive record, the red record comprising two or more layers of differing light sensitivity, each such layer of said red record containing a cyan image dye-forming coupler, the most light sensitive layer of the red record containing a red light sensitized first emulsion having at least one wavelength of peak absorption, and at least one of the two most light sensitive layers of the red record containing a red sensitized second emulsion, wherein the first emulsion exhibits, as measured at 0.2 density units above Dmin, at least one wavelength of peak absorption that is longer than the shortest wavelength of peak absorption of the second emulsion.

2. The element of claim 1 wherein the multilayer peak sensitivity for the entire red record of the multilayer is less than 635 nm at 0.7 above Dmin.

3. The element of claim 2 wherein the first emulsion has a peak sensitivity at a wavelength at least 5 nm longer than that of the second emulsion.

4. The element of claim 3 wherein the first emulsion has a peak sensitivity at a wavelength from 10 to 50 nm longer than that of the second emulsion.

5. The element of claim 4 wherein the first emulsion has a peak sensitivity at a wavelength from 30 to 50 nm longer than the that of the next second emulsion.

6. The element of claim 2 wherein the most light sensitive layer of the red record additionally comprises said second emulsion.

7. The element of claim 6 wherein the first emulsion represents 5–80 wt % of the emulsions in said most light sensitive layer.

8. The element of claim 7 wherein the first emulsion represents 10–70 wt % of the emulsions in said most light sensitive layer.

9. The element of claim 8 wherein the first emulsion represents 15–50 wt % of the emulsions in said most light sensitive layer.

10. The element of claim 2 wherein the second-most light sensitive layer of the red record comprises said second emulsion.

11. The element of claim 1 wherein the red record comprises two red light sensitive layers.

12. The element of claim 1 wherein the red record comprises three red light sensitive layers.

13. The element of claim 1 wherein the red record comprises four red light sensitive layers.

14. The element of claim 2 wherein the first emulsion has a single layer speed at least 0.1 log E faster than the second emulsion.

15. The element of claim 14 wherein the first emulsion has a single layer speed at least 0.2 log E faster than the second emulsion.

16. The element of claim 15 wherein the first emulsion has a single layer speed at least 0.4 log E faster than the second emulsion.

17. The element of claim 16 wherein the first emulsion has a single layer speed at least 0.6 log E faster than the second emulsion.

18. A package containing the photographic element of claim 1, wherein the package indicates an exposure index or ISO speed of 400 or higher.

19. A package containing the photographic element of claim 1 and containing instructions to develop using a color negative process.

20. A package containing the photographic element of claim 1 and containing instructions to develop using a color reversal process.

* * * * *